United States Patent [19]

Rollins

[11] Patent Number: 4,598,178

[45] Date of Patent: Jul. 1, 1986

[54] MEANS FOR CRITICALLY DAMPING A DYNAMIC LOUDSPEAKER

[76] Inventor: William L. Rollins, 704 30th St., Monroe, Wis. 53566

[21] Appl. No.: 562,281

[22] Filed: Dec. 16, 1983

[51] Int. Cl.[4] ..... H04R 9/04; H04R 3/08; H04R 9/00; H04R 1/28

[52] U.S. Cl. ..... 179/115.5 VC; 179/115.5 DV; 179/180; 381/96

[58] Field of Search ..... 179/115.5 VC, 115.5 R, 179/180, 115.5 DV; 381/96

[56] References Cited

U.S. PATENT DOCUMENTS

| | | | |
|---|---|---|---|
| 2,069,254 | 2/1937 | Kunze | 179/115.5 R |
| 3,125,647 | 3/1964 | Rouy | 179/115.5 R |
| 4,160,133 | 7/1979 | Wiik | 179/115.5 VC |

FOREIGN PATENT DOCUMENTS

| | | | |
|---|---|---|---|
| 2733805 | 2/1979 | Fed. Rep. of Germany | 179/115.5 DV |

*Primary Examiner*—Gene Z. Rubinson
*Assistant Examiner*—Danita R. Byrd
*Attorney, Agent, or Firm*—Keith Schoff

[57] ABSTRACT

Critical damping of a dynamic loudspeaker is achieved by placing a supplemental, short circuited coil of similar configuration and mounting alignment to that of the drive coil in rearward adjacency thereto for being biased into the flux gap during extreme forward excursion of the speaker cone and drive coil. External circuit elements connected to the supplemental coil provide desired impedance for damping particular resonant frequencies.

High ambient-temperature performance capability for functioning of a speaker in a public address system or to sound an alarm during a fire is provided by use of an aluminum cone diaphragm and a plastomer coated glass cloth surround.

3 Claims, 1 Drawing Figure

MEANS FOR CRITICALLY DAMPING A DYNAMIC LOUDSPEAKER

BACKGROUND OF THE INVENTION

Signal modulated, alternating-current input to a dynamic loudspeaker drive coil interacts with magnetic flux of the speaker magnet to axially bias the coil-attached speaker cone and acoustically reproduce the signal modulation. At critical frequencies, the driven components will resonate with resulting loss in fidelity of signal reproduction unless the speaker is damped.

PRIOR ART

Dynamic loudspeakers have been damped mechanically, and also magnetically by use of ferrofluids. Additionally, U.S. Pat. No. 3,125,647 discloses short circuited turns of aluminum foil wound as a rigid cylinder for coupling a speaker cone to a drive coil as a means for speaker damping, however, the presence of the foil in the flux gap at all times inhibits transient response, as well as damping resonance at critical frequencies.

SUMMARY OF THE INVENTION

Resonance damping in dynamic loudspeakers is achieved without effect on transient frequency response by a supplemental short circuited coil of axially displaced, but otherwise similar mounting, alignment and configuration to that of the drive coil being provided for biasing unitarily therewith, without, however, entering the flux gap except when maximum excursion is approached. External circuit elements connected into the short circuit of the supplemental coil provide optimum damping at selected frequencies.

Operational reliability at destructively high ambient temperatures when functioning of a speaker might be critically important for public address or for sounding a fire alarm is achieved by provision of an aluminum speaker cone and plastomer coated glass cloth surround.

DESCRIPTION OF THE INVENTION

Figure 1:
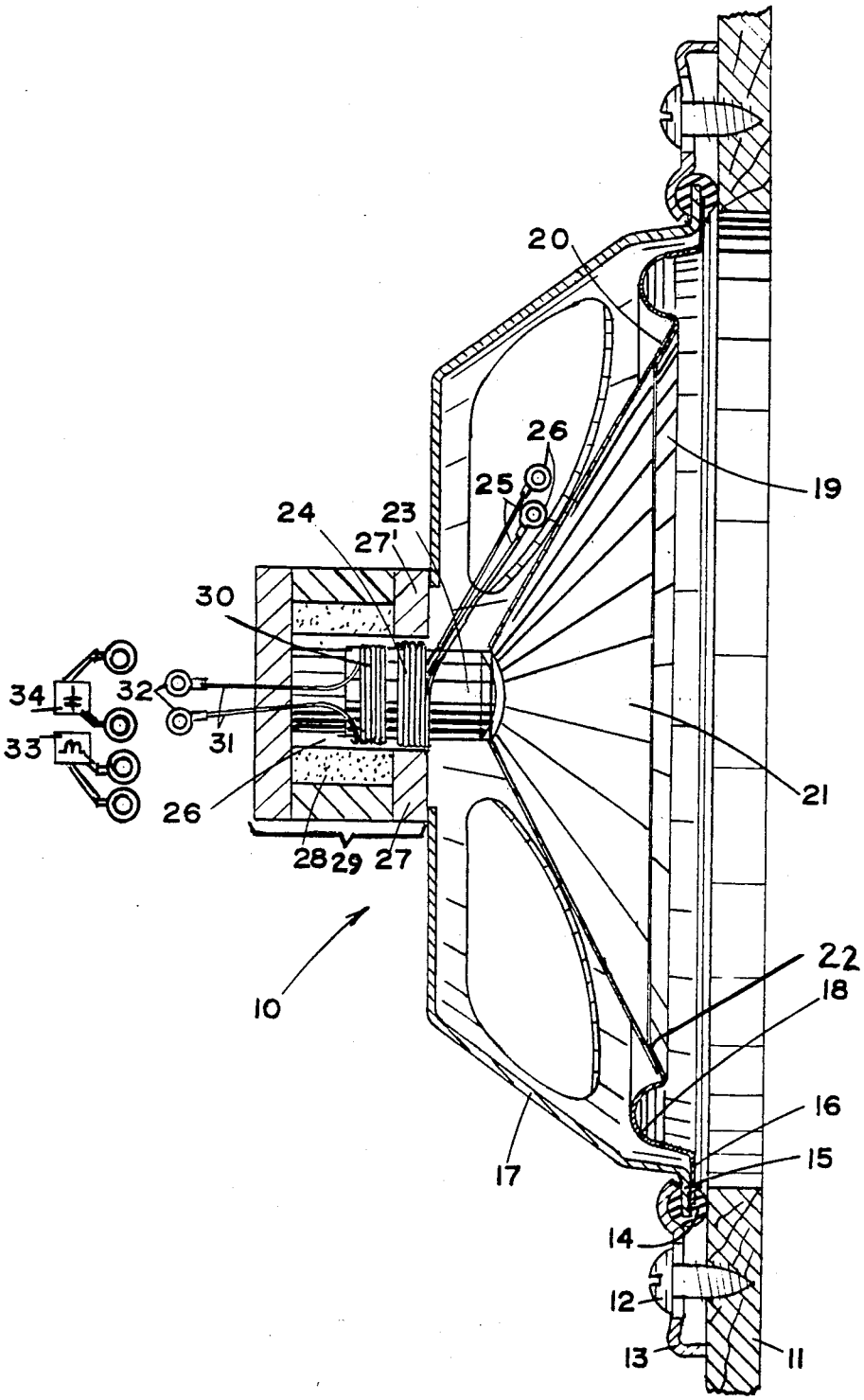
FIG. 1 is an elevation in partial section showing one embodiment of a loudspeaker of this invention.

Speaker 10 is shown in FIG. 1 as being of a moving coil, permanent magnet, dynamic loudspeaker type that is the most commonly used of the various loudspeaker designs commercially available. Resilient gasket 14 encircles the edge of the speaker and is clamped by levered retaining clips 13 under force exerted by screws 12 onto the rear face of baffle 11. Slotted gasket 14 is engaged with the cemented assembly of flange 15 of basket 17 and face portion 16 of surround 18 thereby suspending the driven components of speaker 10 without causing distortion of basket 17 as may occur when a basket is fixed directly to a baffle.

Inner peripheral edge 19 of annular half-roll surround 18 is cemented to outer peripheral edge 20 of trucated cone 21 which acts as both diaphragm and radiator for propagating acoustic energy. Preferably, surround 18 comprises polyvinylchloride resin coated glass cloth fabric and speaker cone 21 comprises aluminum, such materials serving to provide functional capability to speaker 10 at high ambient temperatures for emergency use to sound an alarm or for public address during a fire. Other plastomer coating material may be used, if desired, and other fiber may be employed or a composite material may be used for the speaker cone, examples of such materials being carbon fiber and epoxy or phenolic resin. Inner peripheral edge 19 of surround 18 is cemented to cylinder 23 at its forward extremity, and drive coil 24 is fixedly wound on cylinder 23 with tinsel connecting leads 25 extending externally of speaker 10 for making connection to the output of an amplifier, not shown, through terminal eyes 26. Drive coil 24 is shown as a single layered winding centered in air gap 26 between pole pieces 27, 27' of soft iron frame assembly 29 of permanent speaker magnet 28. Frame assembly 29 provides a path for magnetic flux of magnet 28, which may be either metal or ceramic, or may comprise a field winding on soft iron to provide an electrodynamic moving coil speaker, however, such means are not shown. Alternatively, drive coil 24 may comprise either a multiple layered winding or a plurality of windings situated in multiple air gap locations or may be of any other operable configuration. Basket 17 of stamped metal or of molded resin rigidly supports magnet 28 and frame assembly 29 for operably maintaining alignment between the moving and stationary components of the speaker.

The speaker thus far described is conventional except for materials used for the speaker cone and surround. In addition to conventional features, speaker 10 comprises supplemental coil 30 disposed behind drive coil 24 on cylinder 23 as means for magnetically damping movement of speaker cone 21 at extreme excursion. Coil 30 may consist of a simple short-circulated winding on cylinder 23, but as shown in FIG. 1 is provided with tinsel connecting leads 31 for making connection by means of terminal eyes 32 to external circuit elements, 33, 34, such elements representing added resistance, inductance or capacitance for being inserted into the circuit of coil 30 without connection being made to a power source or to a load other than to provide desired impedance in the circuit. The location of coil 30 on cylinder 23 is determined with respect to the maximum excursion through which speaker cone 21 is to be driven, the spacing being such that coil 30 enters into the high density magnetic flux between pole pieces 27, 27' when cone 21 is approaching the limit of forward excursion, thereby contributing significant inductive reactance opposing linear displacement of cone 21 along the axis of speaker drive. Selection and characterization of impedance values desired in the circuit of coil 30 is determined by resonant frequency for a particular speaker. Resonant frequency is characterized by the combined effect of electrical capacitance together with mechanical and acoustic resilience being equal to and offsetting in value to the combined effect of electrical inductance together with mechanical and acoustic inertia for a particular speaker. At resonant frequency, current in the drive coil and the drive of the speaker cone will be maximum for a given signal voltage with the result that distortion in the reproduction of signal energy as acoustic energy occurs. The magnetic damping effect created by coil 30 entering into the flux gap between pole pieces 27, 27' will be proportional to the rate at which the coil is moved into the flux gap and the distance of axial traverse of the coil into the flux gap. Desirably, coil 30 should be moved into the flux gap at from five to fifteen cycles per second, for example, above resonant frequency, which typically will be in the range of from fifty to one hundred fifty cycles per second for a speaker cone of from eight to twelve inches in diameter. Sharply delineated range of effective impedance can be furnished by selection of values of reactance and resistance for circuit elements 33, 34, the determination of such values being made in accordance with well known principles. Cylinder 23 desirably is made of non-conductive material such as a cellulosic material, but may comprise aluminum or other metal.

The scope of this invention includes all loudspeakers utilizing a moving drive coil, and specifically those speakers having a stationary horn radiator and driven diaphragm, which are the most commonly employed type for propagating frequencies above about eight thousand cycles per second and are most efficient for acoustic propagation at any frequency.

Aluminum cone speakers of this invention provided with a fibrous glass cloth fabric surround coated with a polyvinylchloride solution with a fire retardant such as poly brominated or chlorinated biphenyl added will withstand ambient temperatures of 500 degrees F. for three hours and remain operable or for short duration will function to temperatures to 900 degrees F.

I claim:

1. In a moving coil dynamic loudspeaker embodying a stationary magnet with pole pieces and an axially biasable assembly of a speaker diaphragm, a support member fixedly attached to said diaphragm, and a drive coil carried on said support member wherein said drive coil is disposed between said pole pieces of said speaker magnet, an improvement for damping motion of said assembly at extreme excursion comprising:

a short circuited electrical conductor provided as a coil carried on said support member and displaced axially from said drive coil on said support member a distance sufficient that said short circuited electrical conductor coil enters into a position intermediate said pole pieces only when said assembly approaches maximum excursion, said short circuited electrical conductor coil provided with leads connected to terminals, said terminals being provided to enable impedance of said short circuited electrical conductor coil to be selectively determined by replaceable provision of reactance circuit element means.

2. The loudspeaker of claim 1 wherein said reactance circuit element means comprise at least one discrete member selected from among inductive or capacitive elements for providing desired impedance in said short circuited electrical conductor.

3. The loudspeaker of claim 1 wherein said loudspeaker comprises a permanent magnet.

* * * * *